US009305734B2

(12) United States Patent
Jacquet et al.

(10) Patent No.: US 9,305,734 B2
(45) Date of Patent: Apr. 5, 2016

(54) SEMICONDUCTOR DEVICE FOR ELECTRON EMISSION IN A VACUUM

(75) Inventors: Jean-Claude Jacquet, Orsay (FR); Raphaël Aubry, Gometz le Chatel (FR); Marie-Antoinette Poisson, Paris (FR); Sylvain Delage, Orsay (FR)

(73) Assignee: THALES, Courbevoie (FR)

( * ) Notice: Subject to any disclaimer, the term of this patent is extended or adjusted under 35 U.S.C. 154(b) by 78 days.

(21) Appl. No.: 14/234,328

(22) PCT Filed: Jul. 20, 2012

(86) PCT No.: PCT/EP2012/064346

§ 371 (c)(1),
(2), (4) Date: May 27, 2014

(87) PCT Pub. No.: WO2013/014109

PCT Pub. Date: Jan. 31, 2013

(65) Prior Publication Data

US 2014/0326943 A1 Nov. 6, 2014

(30) Foreign Application Priority Data

Jul. 22, 2011 (FR) ..... 11 02286

(51) Int. Cl.
*H01J 1/308* (2006.01)
*H01J 23/04* (2006.01)

(52) U.S. Cl.
CPC *H01J 1/308* (2013.01); *H01J 23/04* (2013.01)

(58) Field of Classification Search
None
See application file for complete search history.

(56) References Cited

U.S. PATENT DOCUMENTS 5,077,597 A 12/1991 Mishra

FOREIGN PATENT DOCUMENTS

JP 6345736 A 2/1988
WO 2004-102602 A1 11/2004

OTHER PUBLICATIONS

Mitrofanov et al. ("Poole-Frenkel electron emission from the traps in AlGaN/GaN transistors," J. Appl. Phys. 95, pp. 6414-6419, 2004).*
Neuburger et al. ("Unstrained InAlN/GaN Hemt Structure," International Journal of High Speed Electronics and Systems, vol. 14, No. 3, pp. 785-790, 2004).*
A. Ishida et al., "Resonant-Tunneling Electron Emitter in anAlN/GaN System", Applied Physics Letters, vol. 86, No. 18, Apr. 2005, pp. 183102-1 thru 183102-3.

(Continued)

*Primary Examiner* — Yasser A Abdelaziez
(74) *Attorney, Agent, or Firm* — Baker Hostetler LLP

(57) ABSTRACT

A semiconductor device for electron emission in a vacuum comprises a stack of two or more semi-conductor layers of N and P type according to sequence N/(P)/N forming a juxtaposition of two head-to-tail NP junctions, in materials belonging to the III-N family, two adjacent layers forming an interface. The semiconductor materials of the layers of the stack close to the vacuum, where the electrons reach a high energy, have a band gap Eg>c/2, where c is the electron affinity of the semiconductor material, the P-type semiconductor layer being obtained partially or completely, by doping impurities of acceptor type or by piezoelectric effect to exhibit a negative fixed charge in any interface between the layers, a positive bias potential applied to the stack supplying, to a fraction of electrons circulating in the stack, the energy needed for emission in the vacuum by an emissive zone of an output layer.

27 Claims, 8 Drawing Sheets

(56) References Cited

OTHER PUBLICATIONS

N. Maeda et al., "Enhanced Electron Mobility in AlGaN/InGaN/AlGaN Double-Heterostructures by Piezoeletric Effect", Jpn. J. Appl. Phys., vol. 38 No. 7b, Jul. 1999, pp. L799-L801.

C.J. Eiting et al., "P- and N-Type Doping of GaN and AlGaN Epitaxial Layers Grown by Metalorganic Chemical Vapor Deposition", Journal of Electronic Materials, vol. 27, No. 4, Apr. 1998, pp. 206-209.

Search Report dated Nov. 16, 2012 from International Patent Application No. PCT/EP2012/064346.

* cited by examiner

SEMICONDUCTOR DEVICE FOR ELECTRON EMISSION IN A VACUUM

CROSS-REFERENCE TO RELATED APPLICATIONS

This application is a National Stage of International patent application PCT/EP2012/064346, filed Jul. 20, 2012, which claims priority to foreign French patent application no. FR 1102286, filed on Jul. 22, 2011.

FIELD OF THE INVENTION

The invention relates to the sources of so-called cold electrons using a semiconductor diode.

BACKGROUND

Today's electron sources integrated in power microwave amplifier tubes use the thermoelectronic emission obtained by heating electron sources called thermionic cathodes, to temperatures in the vicinity of 1000° C. Because of the physical principle used, these cathodes are limited in terms of emitted electron current and of lifespan, and also include the drawback of taking a fairly long time, of the order of a minute, to obtain the stabilized emission of electrons when they are heated, or switched on.

To circumvent these limitations and improve the efficiency of electron tubes with thermionic emission source, for example, in the case of power traveling wave tubes (TWT), solutions using an emission of electrons with the aid of cold semiconductor sources have been studied to replace the thermionic emission. These types of emissions by cold sources exploit the internal emission of avalanche ionization type or the field emission of tunnel effect type to emit or extract electrons from the semiconductor material.

In a first solution for producing cold electron sources, the emission of electrons is obtained from a PN diode made of silicon or of gallium arsenide, forward biased, the P zone being placed on the surface which is covered by a layer of cesium oxide. The role of this layer of cesium is two-fold:

- to create a depletion zone by the dipole induced on the surface by this oxide where the electrons gain energy in the electrical field prevailing therein,
- to lower the output work of the material in order to facilitate the emission of the electrons in the vacuum.

Cesium oxide is, however, chemically unstable and the diode has to be made to work in a powerful vacuum to increase its lifespan. Even in these conditions, the layer of oxide degrades too rapidly for the device to be able to be used in the tubes. Furthermore, the maximum energy that the electrons can acquire is limited to the curvature of the bands in the vicinity of the surface and is, at best, of the order of the band gap of the materials used (typically less than 2 eV). The energy acquired by the electrons on passing through this zone is therefore less than the electron affinity of these materials which is of the order of 4 eV. Most of the electrons cannot therefore acquire sufficient energy to be emitted into the vacuum and only a small fraction, the most energetic of the electron distribution, leaves the material, hence low emission efficiency.

In a variant of this first solution, a metal of low electron affinity ($LaB_6$ for example) replaces the layer of cesium oxide. The structure produced is used in diode mode, the electrical contacts being taken on the N-doped part of the diode and on the metal of low electron affinity. However, the gain in emission obtained by lowering the electron affinity using the material placed on the surface is wiped out by the energy losses induced by the collisions of the hot electrons with the network of the metal passed through.

A second solution uses a PN diode made of silicon or of gallium arsenide that is reverse biased beyond its avalanche breakdown voltage, the N zone being placed on the surface. In this approach, the current is obtained by avalanche multiplication and only the electrons that have an energy greater than the electron affinity of the material are emitted into the vacuum.

Given the semiconductors used, such devices have a very low emission efficiency. To increase the emission of electrons, a layer of cesium oxide is also deposited on the emissive surface but, as in the first solution, the instability of this oxide limits the lifespan of these devices.

A third avenue for producing cold electron sources exploits the field emission. In this solution the electrons are extracted from the material by tunnel effect using an intense external electrical field generated by point effect, either from molybdenum cones as in the Spindt cathodes, or from carbon nanotubes. These two solutions have not however led to any applications, the Spindt cathodes undergoing an accelerated degradation under the effect of the ion bombardment generated by the intense electrical field prevailing at the summit of the cones, and the carbon nanotubes not emitting a sufficient current density (effective emitted current density of the order of 1 $A/cm^2$).

A fourth solution uses an NPN GaN bipolar transistor or the contact of the collector layer placed on the surface is pierced so as to allow for the emission of the electrons into the vacuum. The forward-biased base-emitter junction allows for the input of electrons, the reverse-biased base-collector junction makes it possible to provide the electrons with the energy needed for their extraction from the semiconductor. The impossibility of obtaining a strong concentration of holes at ambient temperature for P-doped GaN results in a high base access resistance value. This is reflected in the appearance of a phenomenon of lateral depolarization of the base-collector junction leading to a concentration of the current at the periphery of the component. The effective emissive surface is thus greatly reduced and represents no more than a small fraction of the total surface area of the transistor which results in a low emission efficiency.

None of the solutions described previously have to date made it possible to produce an electron source which is both reliable and intense enough to compete with the thermionic cathodes used today in the power tubes.

SUMMARY OF THE INVENTION

To mitigate the drawbacks of the cold sources of the prior art, the invention proposes a semiconductor device for electron emission into a vacuum comprising a stack of q semiconductor layers, q being a number greater than or equal to 2, of N and P type according to the sequence N/(P)/N forming a juxtaposition of two head-to-tail NP junctions, the semiconductor layers being produced in semiconductor materials belonging to the III-N family, two adjacent layers of the stack forming an interface, the stack comprising two ends, at one of its ends, at least one emitter ohmic contact land EMT on a free surface of a first layer L1 of the stack and, at the other end, at least one collector electrical contact land COL (which will preferentially be of Schottky type) on a part of another free surface of an output layer L5 in contact with the vacuum for the emission of the electrons by an emissive zone of said output layer L5, characterized in that the semiconductor materials of the layers of the stack close to the vacuum, where the electrons reach a high energy, have a band gap Eg whose value satisfies the following inequality: Eg>c/2, in which c is the electron affinity of the semiconductor material, the P-type semiconductor layer being obtained partially or completely by piezoelectric effect so as to exhibit a negative fixed charge in any one of the interfaces between the layers of the stack, the piezoelectric effect being of spontaneous and/or constrained type, the device comprising biasing means for applying a positive bias potential to one of the contact lands relative to a reference potential applied to the other contact land so as to forward bias the junction set to the reference potential and reverse bias the one set to the positive bias potential, the internal electrical field induced by the positive bias potential applied to the stack of semiconductor layers supplying, to a fraction of the electrons circulating in said stack, the energy needed for their emission into the vacuum by the emissive zone of the output layer L5.

In a particular embodiment of the electron emission device, the stack comprises, between its two ends, the first layer L1 of N type, a layer L3 of P type, a layer L4 of N type and the output layer L5 of N type on the layer L4, the positive bias potential being applied to the collector electrical contact of the output layer L5, the reference potential being applied to the electrical contact of the first layer L1.

In a particular embodiment, the negative fixed charge in the stack is also obtained by doping of the layer L3 with impurities of acceptor type.

In another particular embodiment, the negative fixed charge is also obtained between the layer L4 and the first layer L1 partly by doping of the layer L3 partly with impurities of acceptor type and partly by piezoelectric effect by the choice of the chemical composition of the layer L1, said layer having a composition of the $Al_xGa_{1-x}N$ or $Al_xIn_{1-x}N$ type and the layers L3, L4 and L5 having a composition of the $Al_yGa_{1-y}N$ or $Al_yIn_{1-y}N$ type with x greater than 0 and less than or equal to 1 and with y greater than or equal to 0 and less than 1 and such that x>y.

In another embodiment of the electron emission device, the stack comprises a semiconductor layer L2 between the first layer L1 and the layer L3 of P type, the adjacent layers L2 and L3 exhibiting a composition difference such that a piezoelectric charge of negative sign appears at the interface of these layers.

In another embodiment of the electron emission device, the composition of the semiconductor material of the layer L2 is different from the composition of the material of the layer L1 such that a positive piezoelectric charge appears at the interface between these two layers.

In another embodiment of the electron emission device, the stack comprises the first layer L1 of N type, the output layer L5 of N type and, between the first layer L1 and the output layer L5, a layer L4 of N type, the negative charge being obtained between the layer L4 and the first layer L1 by piezoelectric effect only.

In another embodiment of the electron emission device, the stack comprises the first layer L1 of N type, the output layer L5 of N type and, between the first layer L1 and the output layer L5, a layer L2 of P type and a layer L4 of N type, with a doping less than 5 $10^{17}$ $cm^{-3}$, the negative charge being induced by piezoelectric effect at the interface between these said adjacent layers by the choice of the chemical composition of the layers L1 to L4, said layers will have a composition of the $Al_xGa_{1-x}N$ or $Al_xIn_{1-x}N$ type for the layers L1 and L2 and of the $Al_yGa_{1-y}N$ or $Al_yIn_{1-y}N$ type for the layers L3 and L4 with x greater than 0 and less than or equal to 1 and with y greater than or equal to 0 and less than 1 and such that x>y.

In another embodiment of the electron emission device, the stack comprises the first layer L1 of N type, the output layer L5 of N type and, between the first layer L1 and the output layer L5, a layer L2 of N type and a layer L4 of N type, the negative charge being induced by piezoelectric effect at the interface between two layers.

In another embodiment of the electron emission device, the stack comprises a semiconductor layer L2 of any type having a thickness less than 200 nm adjacent to the first layer L1.

In another embodiment of the electron emission device, the output layer L5 of N type is doped between $10^{18}$ $cm^{-3}$ and $10^{20}$ $cm^{-3}$ and is of a thickness t less than or equal to 50 nm.

In another embodiment of the electron emission device, the semiconductor layer L4 of N or P type adjacent to the output layer L5 has a doping less than 5 $10^{17}$ $cm^{-3}$ and is of a thickness less than or equal to 100 nm.

In another embodiment of the electron emission device, the doped semiconductor layer L3 of P type between some $10^{18}$ $cm^{-3}$ and some $10^{20}$ $cm^{-3}$ arranged between the output layer L5 and the first layer L1 has a thickness less than 200 nm.

In another embodiment of the electron emission device, the stack comprises a semiconductor layer L2 between the first layer L1 and the layer L3 of any type having a thickness less than 200 nm adjacent to the layer L1.

In another embodiment of the electron emission device, the first doped layer L1 of N type between some $10^{18}$ $cm^{-3}$ and some $10^{20}$ $cm^{-3}$ is of any thickness.

In another embodiment of the electron emission device, the composition of the semiconductor materials of the adjacent layers L1 and L4 is chosen so as to exhibit a composition difference such that a piezoelectric charge of negative sign appears at the interface between these layers L1 and L4.

In another embodiment of the electron emission device, the semiconductor materials of the adjacent layers L2 and L4 exhibit a composition difference such that a piezoelectric charge of negative sign appears at the interface of these layers.

In another embodiment of the electron emission device, the layers L1 and/or L2 are chosen from the semiconductor materials:

$$Al_xGa_{1-x}N,\ In_xGa_{1-x}N,\ Al_xIn_{1-x}N \text{ or } (In_yAl_{1-y})_xGa_{1-x}N$$

In another embodiment of the electron emission device, the layers L1 and/or L2 being of $In_{17}Al_{83}N$, the other layers of the stack are of GaN so that the mesh parameters of these layers are identical.

In another embodiment of the electron emission device, the layer L3 being doped between some $10^{18}cm^{-3}$ and some $10^{20}cm^{-3}$ at a thickness less than 200 nm.

In another embodiment of the electron emission device, the stack is produced from a substrate chosen from gallium nitride or GaN, silicon carbide or SiC, silicon or Si, sapphire or $Al_2O_3$.

In another embodiment of the electron emission device, the emitter ohmic contact land on the first layer L1 is on a peripheral zone of said layer L1, to receive the bias potential.

In another embodiment of the electron emission device, the emitter ohmic contact land on the layer L1 is arranged at the periphery to form a closed contour.

In another embodiment of the electron emission device, the emitter ohmic contact land on the first layer L1 comprises two contact parts arranged at the periphery and facing one another.

In another embodiment of the electron emission device, the two emitter ohmic contact parts are 1 to 10 μm away from the collector mesa consisting of the layers L2 to L5.

In another embodiment of the electron emission device, the emitter ohmic contact land is on the rear face of the first layer L1, on a zone of said first layer L1 vertically in line with the emissive zone.

In another embodiment of the electron emission device, the collector electrical contact land on the output layer L5 is a Schottky contact land arranged on a peripheral zone of said output layer L5, to receive the bias voltage.

In another embodiment of the electron emission device, the collector electrical contact land on the output layer L5 is arranged at the periphery to form a closed contour.

In another embodiment of the electron emission device, the output layer L5 comprises two collector electrical contact lands arranged at the periphery of said layer and facing one another at a distance of between 1 μm and 100 μm.

In another embodiment of the electron emission device, the first layer L1 and the output layer L5 each comprise a multitude of mutually parallel contact lands separated by a distance of between 1 μm and 100 μm.

One main aim of the device for emitting electrons into a vacuum according to the invention is to obtain an emitted electron current that is greater than that of the electron emission devices of the prior art.

Other aims are to improve the lifespan and reduce the bulk of the devices for emitting electrons into a vacuum.

The proposed structure is made up of a stack of semiconductor layers of N/(P)/N type, produced in semiconductor materials belonging to the III-N family, in which the P zone is not electrically connected and is obtained partially or wholly by doping with impurities of acceptor type (layer L3) or by piezoelectric effect. This effect will be obtained by a suitable choice of chemical compositions of the materials making up the layers of the stack such that the spontaneous and/or constrained piezoelectric effect causes a negative fixed charge to appear between any one of the interfaces situated between two adjacent layers of the stack.

The stack thus produced is formed from the juxtaposition of two junctions mounted head-to-tail, of which a few examples of possible stacks are described hereinbelow. The application of a positive voltage to one of the electrodes of the diode makes it possible to forward bias the junction whose contact is set to the reference potential (for example a ground M) and, in reverse, the one whose contact is set to the positive voltage. If the density of negative charges is sufficient, the internal electrical field induced by the positive voltage applied can be sufficiently intense to supply a fraction of the electrons circulating in the device with the energy needed for their emission into the vacuum. This fraction will be all the greater when the material chosen has a large band gap. To this end, the specific properties of the compounds of the family of materials $Al_xGa_{1-x}N$, $In_xGa_{1-x}N$, $Al_xIn_{1-x}N$ or $(In_yAl_{1-y})_xGa_{1-x}N$ make them particularly interesting for this type of device.

For $Al_xGa_{1-x}N$ for example, we have:

1—presence of energy levels greater than an electron-volt,

2—band gap of between approximately 3.4 and 6.2 eV when x varies from 0 to 1.

The result of these properties is that the electrons, under the effect of the electrical field, will have a high average energy and a significant fraction of these electrons will be present at energies greater than the electron affinity of the material. The electron emission will then be able to be obtained without it being necessary to deposit a material with low electron affinity on the emissive surface.

In addition to the fact that it is not necessary to use such materials, a second advantage results from the implementation that we have prioritized. The method selected for heating the electron gas in the emission device according to the invention is in fact much more effective than that used for the thermionic cathodes because it is selective. Unlike these thermionic devices, not all of the material is heated, only the free carriers via the internal electrical field induced by the powering up of the diode. Electron temperatures of several tens of thousands of degrees are thus possible in materials with large band gap such as those belonging to the III-N family. The temperature of the network, determined by Joule's law, then remains lower than that of the electron gas by several orders of magnitude. This is why the term "cold cathode" is used, since the network is, in relation to the electrons emitted into the vacuum, much colder.

For its part, the choice of the NPN structure is dictated by the material. The P-type doping of this family of semiconductors is in fact much more difficult to produce than the N-type doping which is well controlled. The access resistance of N-doped layers is thus several orders of magnitudes lower than that of P-doped layers. The biasing of the device through exclusively N-doped layers, made possible with this type of stack according to the invention, improves the distribution of the current in the component and makes it possible to obtain a much more intense and spatially uniform emission than if one of the electrical contacts was taken on a P-doped layer. A gain of 3 to 4 orders of magnitude on the emitted current is expected with this method.

A shrewd choice of the chemical compositions of the materials forming the two junctions of the diode will also make it possible to supply the electrons with additional energy. This input will be equal to the discontinuity of the conduction bands which appears at the interface of these two junctions as in structures of $Al_xGa_{1-x}N/GaN$ or $Al_xIn_{1-x}N/GaN$ type for example (see FIG. 13).

In order to optimize the electron emission, the N-doped layer situated on the surface of the stack will have to be thin and strongly doped. Typically, this layer will have to have a thickness of less than 50 nm and a doping greater than some $10^{18}$ $cm^{-3}$. Ideally, the thickness and the doping thereof will be chosen in such a way that, when the component is biased in emission, the non-depleted part of this layer will be sufficiently thin to minimize the cooling of the electrons which pass through it but thick enough to avoid the lateral depolarization of the reverse-biased diode. To allow for the emission of the hot electrons, the electrical contact of the N-doped layer situated on the surface is pierced.

BRIEF DESCRIPTION OF THE DRAWINGS

The invention will be better understood from examples of embodiments, with reference to the indexed drawings in which.

DETAILED DESCRIPTION

Figure 1:
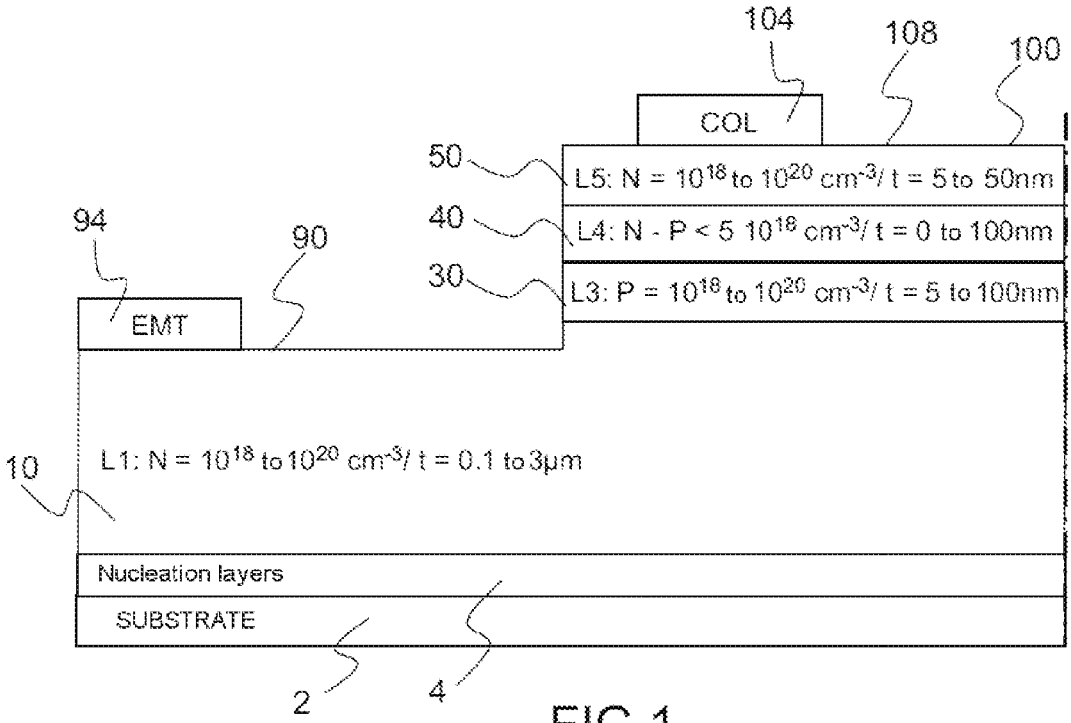
FIGS. 1 to 7 show simplified cross-sectional views of different embodiments of the electron emission device according to the invention.

FIG. 1 shows a cross-sectional view of a first embodiment of the electron emission device according to the invention.

In this first embodiment, a substrate (2) with nucleation layers (4) comprises a stack of semiconductor layers:

a first layer L1 (10) of N type doped between $10^{18}$ $cm^{-3}$ and $10^{20}$ $cm^{-3}$ and of thickness t between 0.1 μm and 3 μm, on the first layer L1, a layer L3 (30) of P type doped between $10^{18}$ $cm^{-3}$ and $10^{20}$ $cm^{-3}$ and of thickness between 5 nm and 100 nm, on the layer L3, a layer L4 (40) having a doping of P or N type less than some $10^{18}$ $cm^{-3}$ and of a thickness t between 0 nm and 100 nm, an output layer L5 (50) on top of the layer L4 of N type doped between $10^{18}$ $cm^{-3}$ and $10^{20}$ $cm^{-3}$ and of thickness between 5 nm and 50 nm.

The layers L3, L4 and L5 partially cover the layer L1 so as to leave a free surface (90) on this layer L1 for an emitter ohmic land EMT 94 intended to receive a reference potential, for example the potential of a ground M.

The output layer L5 comprises an outer surface (100) in contact with the vacuum comprising, on a part of the outer surface, a collector electrical land COL 104 for the application of a positive bias Vice relative to the reference potential M. Another part of the outer surface 100 of the layer L5 is an emissive surface 108 of the output layer L5 through which the emission of the electrons into the vacuum is performed.

In the embodiment of FIG. 1, the negative fixed charge $\sigma^-$ is obtained by doping the layer L3 with impurities of acceptor type.

Figure 2:
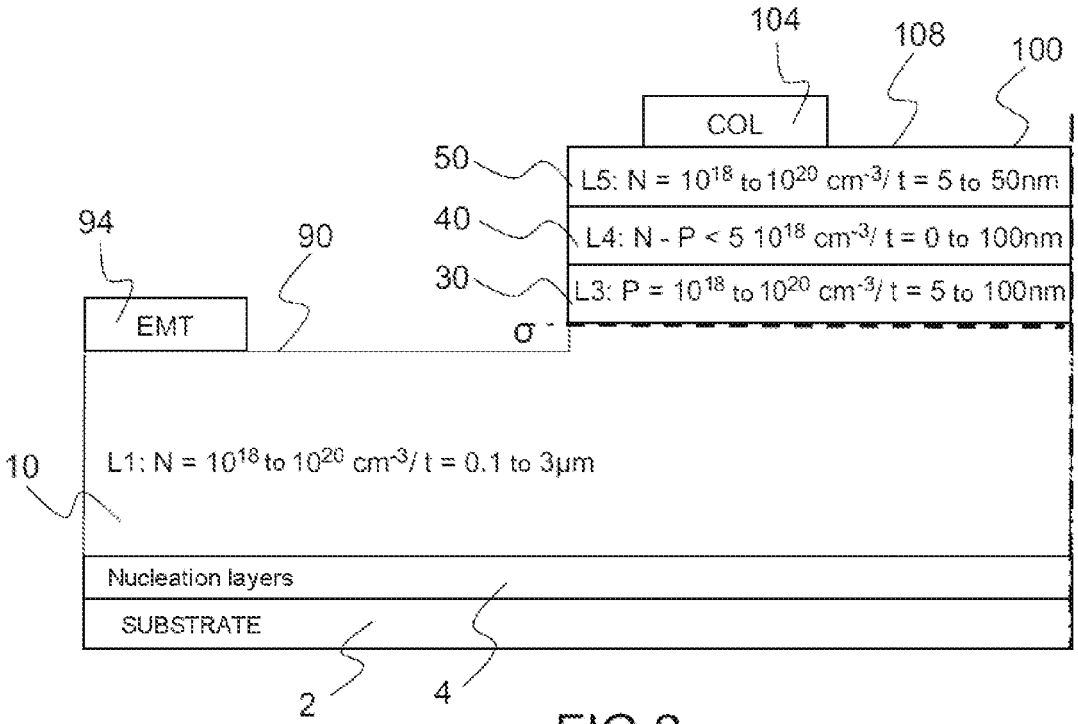

FIG. 2 shows a cross-sectional view of a second embodiment of the electron emission device according to the invention.

In this second embodiment, comprising the stack of layers L1, L3, L4, L5 of FIG. 1, a negative fixed charge ($\sigma^-$) is obtained partly by doping of the layer L3 with impurities of acceptor type and partly by piezoelectric effect obtained at the interface between the layers L1 and L3 by a suitable choice of the chemical composition of said layers.

Figure 3:
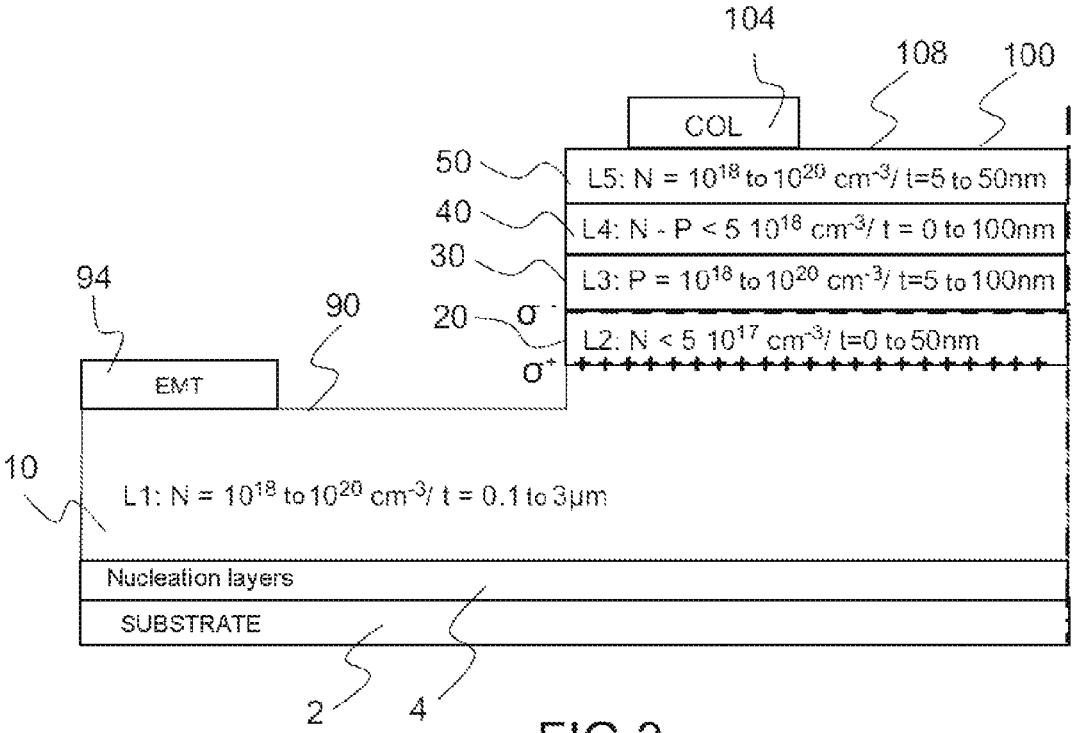

FIG. 3 shows a cross-sectional view of a third embodiment of the electron emission device according to the invention.

In the embodiment presented in FIG. 3, a layer L2 is added to the stack presented in FIG. 1, having a doping of P or N type less than some $10^{17}$ $cm^{-3}$ and of a thickness t less than 50 nm.

In this embodiment of FIG. 3, a negative charge $\sigma^-$ is obtained by piezoelectric effect at the interface between the P-doped layer L3 and the layer L2. The layer L2 exhibits a composition difference with the layer L1 such that a positive charge σ+ by piezoelectric effect appears in the interface between the layer L2 and the first layer L1. For example, the different materials of these layers L1 and L2 are chosen from the following chemical compounds:

$$In_yAl_{1-y}N, \text{ or } Al_xGa_{1-x}N, \text{ or } In_xGa_{1-x}N \text{ or } (In_yAl_{1-y})_xGa_{1-x}N$$

Figure 4:
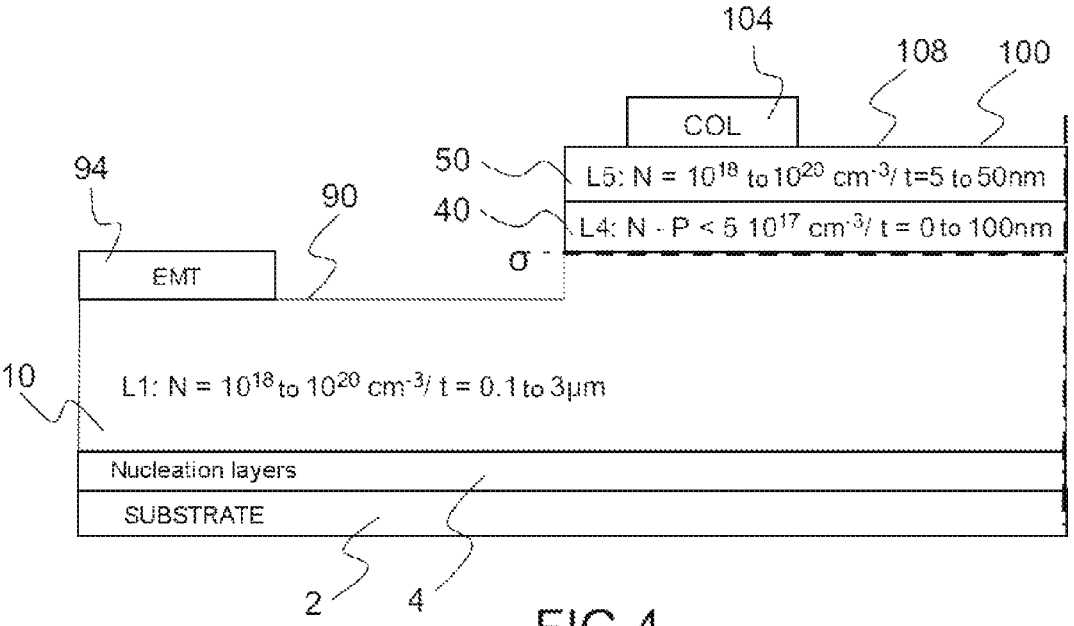

FIG. 4 shows a cross-sectional view of a fourth embodiment of the electron emission device according to the invention.

In this fourth embodiment, the stack comprises, between the first layer L1 of N type and the output layer L5 of N type, a layer L4 for which the doping of N or P type is less than 5 $10^{17}$ $cm^{-3}$. The composition difference of the layers L1 and L4 causes a negative charge ($\sigma^-$) to appear at the interface between said layers as a result of the piezoelectric effect, thus forming the two head-to-tail junctions N/(P)/N. The layer L1 will, for example, have a composition of the $Al_xGa_{1-x}N$ type and the layer L4 will, for example, have a composition of the $Al_yGa_{1-y}N$ type with x greater than 0 and less than or equal to 1 and with y greater than or equal to 0 and less than 1, and such that x>y.

Figure 5:
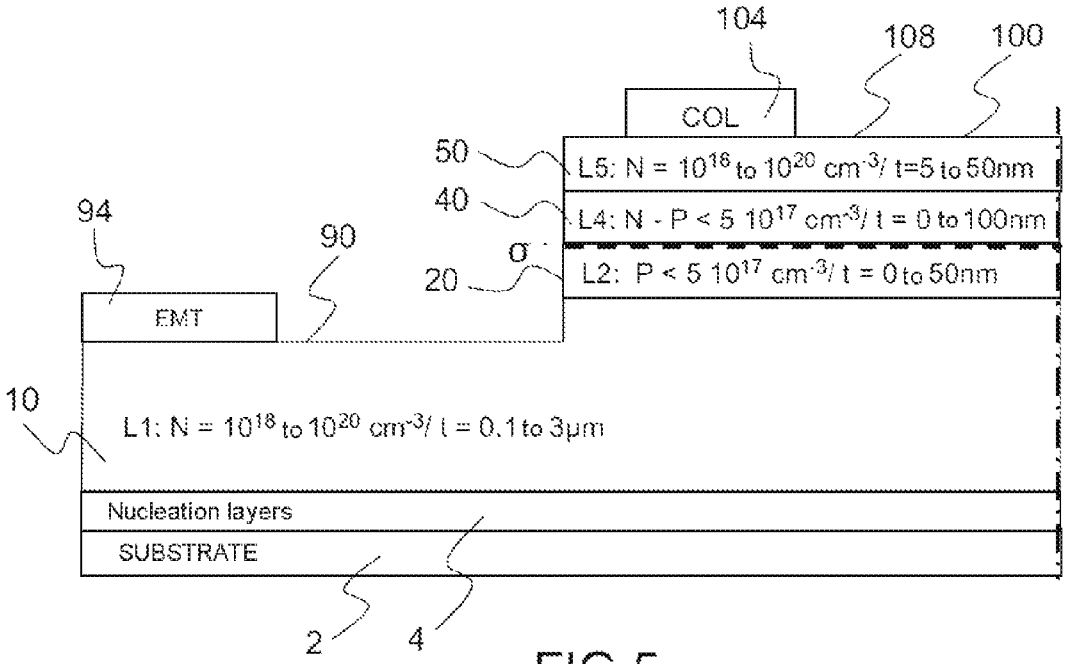

FIG. 5 shows a cross-sectional view of a fifth embodiment of the electron emission device according to the invention.

In this fifth embodiment, there is inserted, between the layers L1 and L4 of the structure described in FIG. 4, a layer L2 doped with P-type impurities to a level less than 5 $10^{17}$ $cm^{-3}$ and of a thickness less than or equal to 50 nm. The chemical composition of the layers L1 and L2 is such that a negative charge ($\sigma^-$) induced by piezoelectric effect appears at the interface between the two layers L2 and L4. The layers L1 and L2 will, for example, have a composition of the $Al_xGa_{1-x}N$ type and the layers L4 and L5 will, for example, have a composition of the $Al_yGa_{1-y}N$ type, with x greater than 0 and less than or equal to 1 and with y greater than or equal to 0 and less than 1, and such that x>y.

Figure 6:
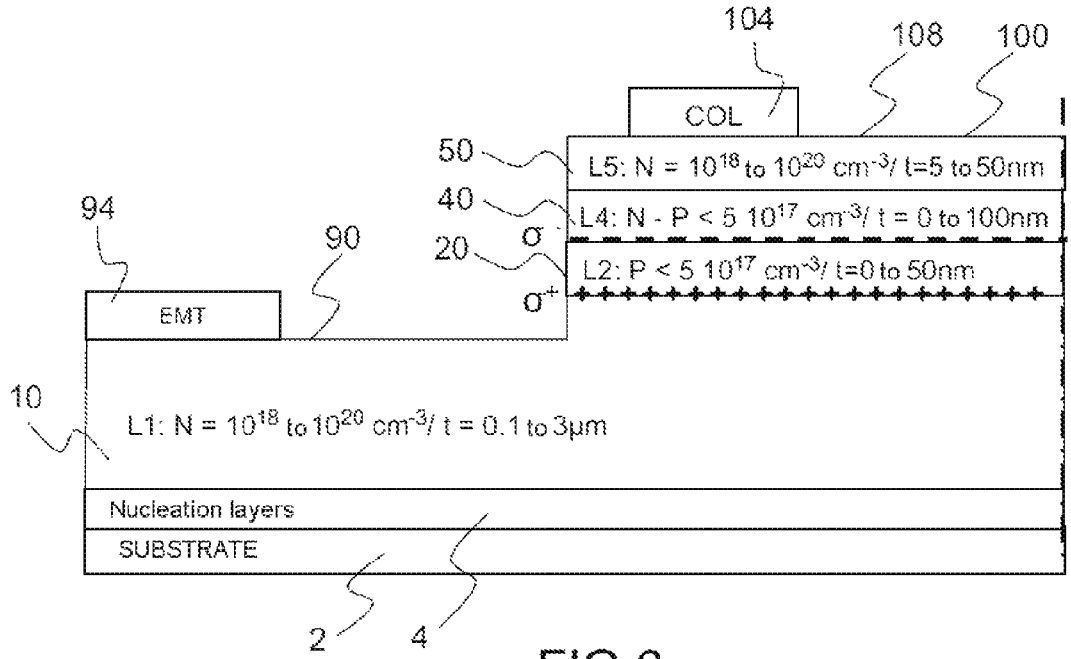

FIG. 6 shows a cross-sectional view of a sixth embodiment of the electron emission device according to the invention.

In the case of this sixth embodiment, the chemical composition of the layer L1 of the structure proposed in FIG. 5 is such that a positive charge ($\sigma^+$) appears at the interface between the layers L1 and L2, induced by piezoelectric effect, and the layer L2 is doped with impurities of N or P type to a level less than or equal to 5 $10^{17}$ $cm^{-3}$.

The structure of the electron emission device according to the invention is similar to a bipolar transistor structure with collector and with emitter. It thus uses the same fabrication techniques, that are well known to a person skilled in the art, for this type of component, except that the contact land (for the collector) on the output layer L5 of the stack in contact with the vacuum must only partially cover its surface. This contact land, or ohmic land, is confined to the edges of the layer, so as to offer an effective surface for electron emission into the surrounding medium, i.e. the vacuum.

Figure 7:
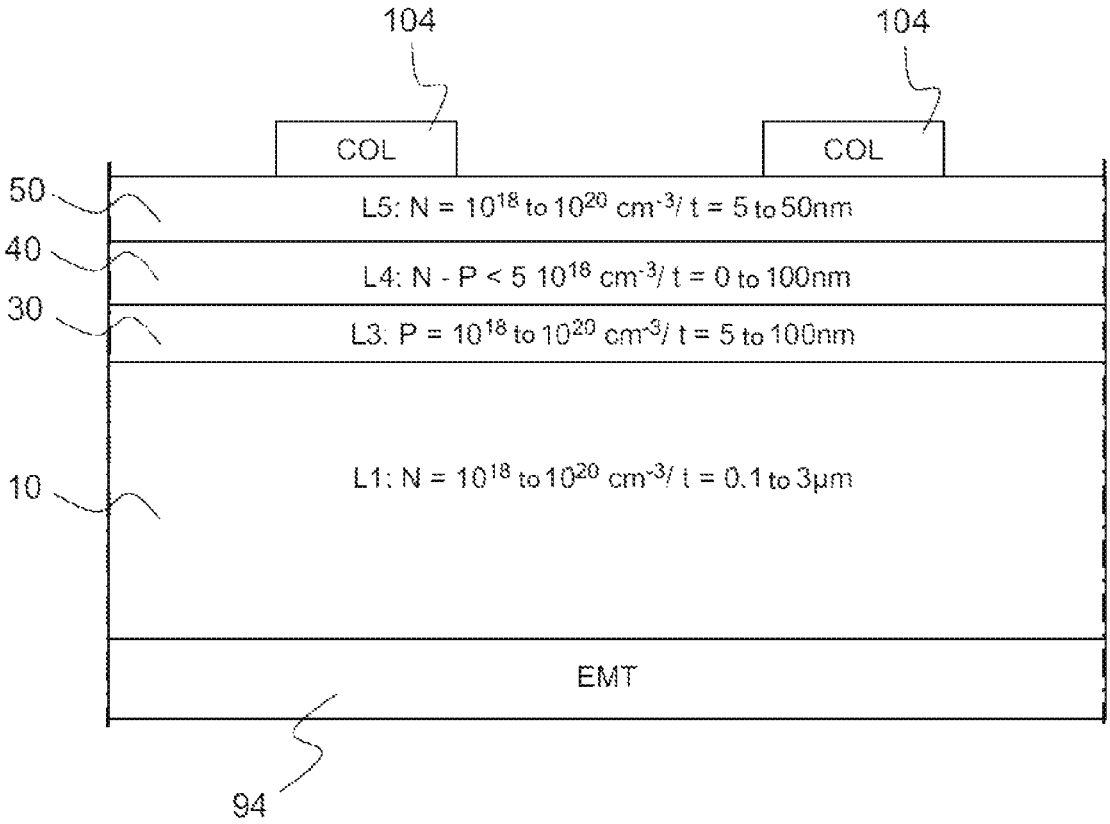

FIG. 7 shows a cross-sectional view of a first variant of the emission device according to the invention.

In this first variant, all the layers of the stack have the same covering surface area, the emitter contact land EMT is then produced at the end of the device on the free face of the first layer L1. The surface of the output layer L5 comprises, in this variant, a multitude of collector contact lands COL.

The different modes of operation of the device for emitting electrons into a vacuum according to the invention are described hereinbelow.

FIGS. 8 to 12 show different operations of the electron emission device according to the invention, as well as the conduction bands in the thickness of the layers of the stack in balance and under bias voltage.

Two modes of operation of the device can be envisaged, by breakdown or by piercing of the reverse biased PN diode (or junction). The mode of operation will depend on the density of negative charges contained, for example in the layer L3, and present at the interface between this layer L3 and the adjacent layers. For GaN, operation in breakdown mode will be obtained for a density of negative charges greater than approximately 2 to $3\times10^{13}/cm^2$. This charge density will depend on the material used, on the dopings of the layers forming the junction and on the thickness of the non-doped layer inserted therein.

Figure 8:
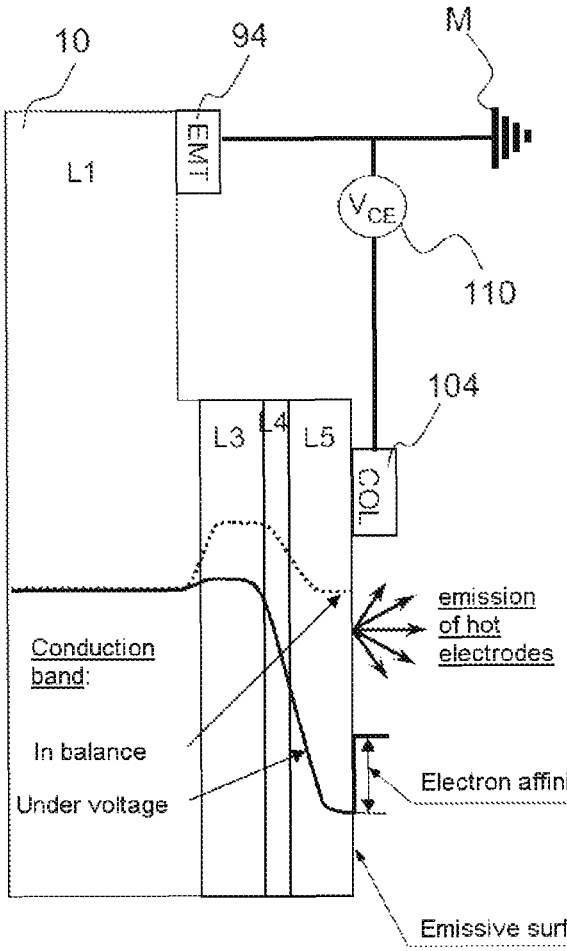
FIGS. 8 to 12 show different operations of the electron emission device according to the invention.
Figure 9:
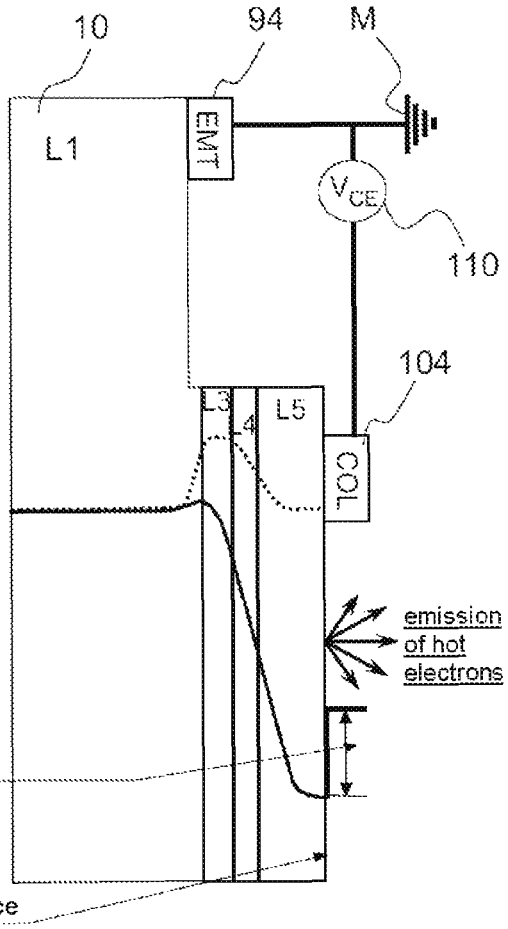

FIG. 8 shows a configuration comprising the layers L1, L3, L4, L5 operating in breakdown mode. FIG. 9 shows the same configuration with a thinner layer L3 thickness operating in piercing mode.

Figure 10:
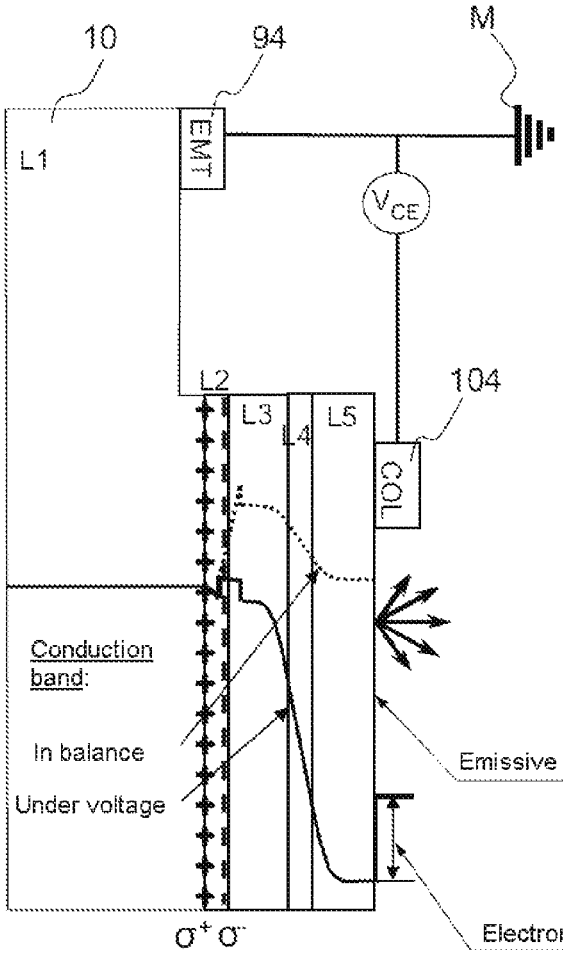

FIG. 10 shows another configuration (see also FIG. 3) comprising a stack of layers L1, L2, L3, L4, L5 operating in breakdown mode.

Figure 11:
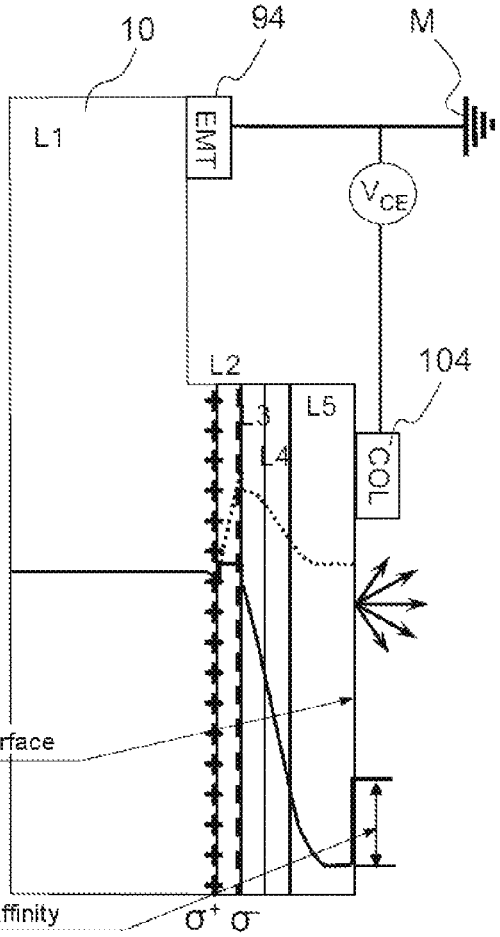

The same configuration represented in FIG. 11 having a thinner layer L3 thickness will be able to operate in breakdown mode or in piercing mode depending on the value of the piezoelectric charge.

Figure 12:
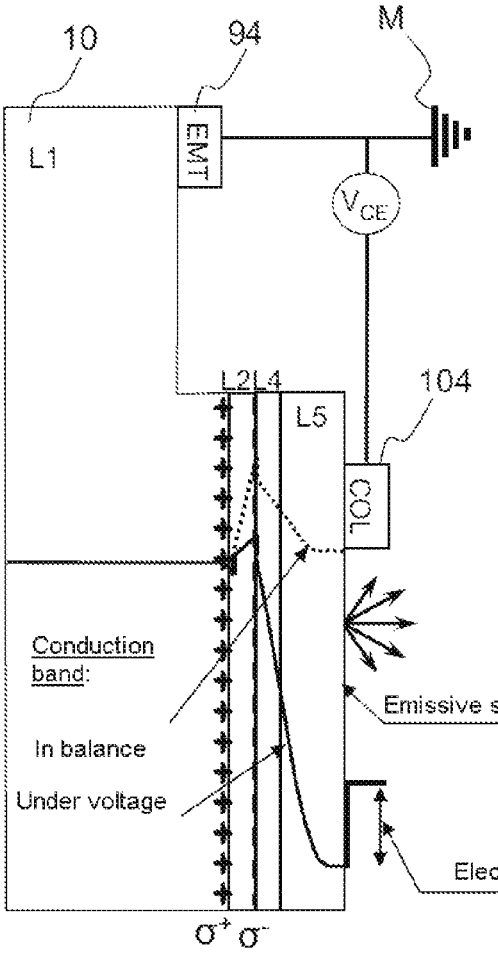

FIG. 12 shows another configuration comprising the layers L1, L2, L4 L5 (see also FIG. 6) with thin layers L2 and L4 operating in piercing or breakdown mode.

Figure 13:
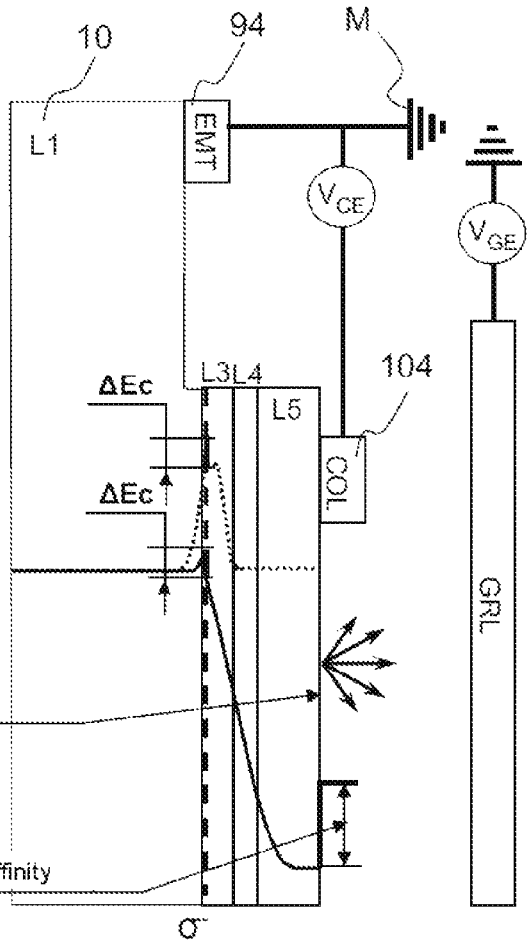
FIG. 13 shows a configuration of the emission device according to the invention producing a conduction band discontinuity.

FIG. 13 shows a configuration of the emission device according to the invention producing a conduction band discontinuity. In this embodiment, the chemical composition of the layer L1 differs from those of the layers L3 to L5 in such a way as to produce a conduction band discontinuity between the layers L1 and L3. This discontinuity is used to give the electrons a surplus of energy. The chemical composition of the layers L1 will be chosen from the family of compounds $Al_xGa_{1-x}N$ or $Al_xIn_{1-x}N$ for example, with x greater than 0 and less than or equal to 1, and that of the layers L2 to L5 will be chosen from the family of compounds $Al_yGa_{1-y}N$ or $Al_yIn_{1-y}N$ for example, with y greater than or equal to 0 and less than 1, and will be such that x>y.

The electron emission by the device according to the invention will occur when the electrical field prevailing within the reverse-biased junction is greater than the avalanche ionizing field, the P-doped layer, floating, being able to be partially or totally depleted as indicated schematically in FIGS. 8 and 10 and in FIGS. 9, 11 and 13 respectively. The piercing mode (see FIGS. 9, 11 and 13) will be obtained by a density of negative charges $\sigma^-$ less than approximately 2 to $3\times10^{13}/cm^2$ for GaN and will also depend on the materials, dopings and thicknesses used. Ideally in this mode of operation, the junction will be biased at the threshold of its avalanche breakdown voltage. This implementation will require an accurate control of the density of negative charges (therefore of the doping and of the thickness of the layer L3 as well as of the fixed charge obtained by piezoelectric effect). Typically, the layer L3 will have a thickness less than 100 nm and a doping greater than some $10^{18}$ $cm^{-3}$.

In this solution according to the invention, the energy is supplied selectively to the electrons using an internal electrical field. This method thus makes it possible to avoid the application of an intense external electrical field or heating the cathode to obtain an emission of electrons. Coupled with the use of semiconductors with large band gap, this implementation makes it possible to bring the electrons to energies greater than the electron affinity of these materials which frees us from the need to use specific materials to lower the output work such as $Cs_2O$ or $LaB_6$ for example. This solution therefore makes it possible to exceed the limitations of the existing solutions (thermionic cathodes), overcomes the imperfections of the solutions under study (Spindt cathodes, nanotubes) and makes it possible to consider the production of electron sources which are simultaneously more intense, having an increased reliability as well as a response time that is much faster than those of the prior art.

Figure 14A:
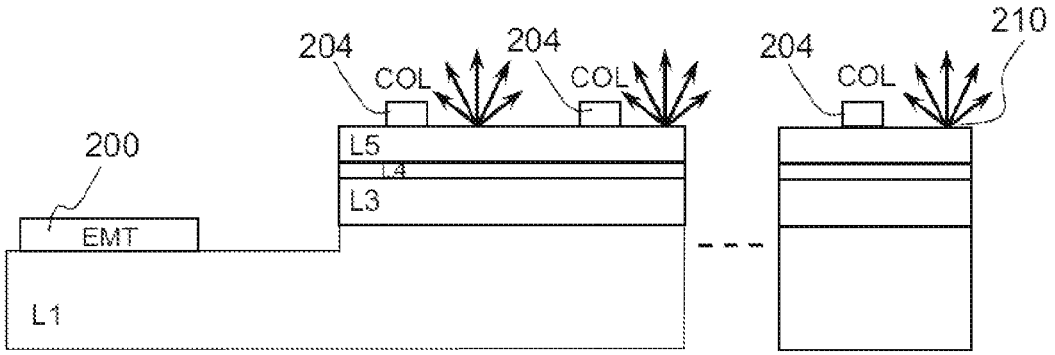
FIG. 14*a* shows a cross-sectional view of a variant of the emission device according to the invention.
Figure 14B:
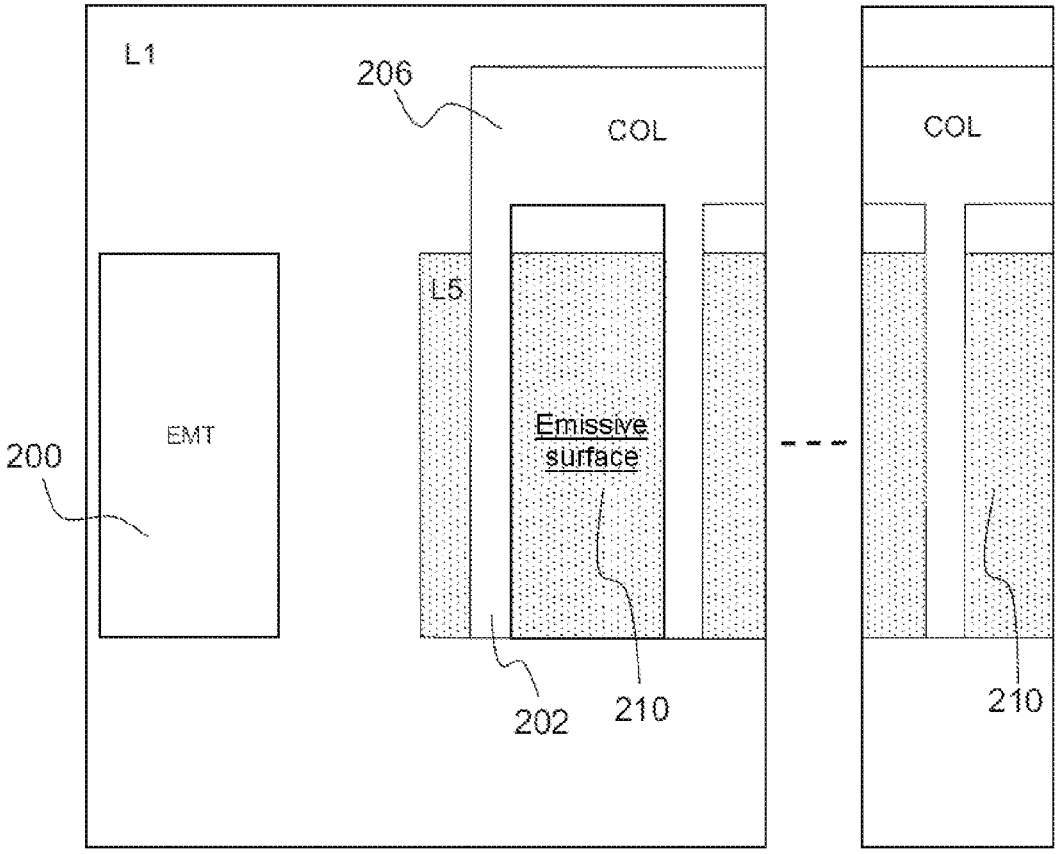
FIG. 14*b* shows a side view of an output layer of the device of FIG. 14*a*.

FIG. 14*a* shows a cross-sectional view of a variant of the emission device according to the invention. FIG. 14*b* shows a side view of an output layer, of the device of FIG. 14*a*.

In the electron emission devices of FIGS. 1 to 6, the stack of semiconductor layers comprises a single emitter ohmic contact land EMT on a free surface of the first layer L1 of the stack and, at the other end, a single collector electrical contact land COL on a part of another free surface of an output layer L5 in contact with the vacuum.

These contact land configurations are not limiting and can be produced, either by two contact parts, or by contacts on the outline of the layers, or by a multitude of Schottky contacts arranged in parallel on the output layer L5.

FIGS. 14*a* and 14*b* show possible contact configurations of a stack comprising a first layer L1 having a single emitter ohmic contact land EMT 200 and, partially covering the layer L1, a stack of layers L3, L4 and the output layer L5.

Electrical contacts COL 204 are arranged regularly on the surface of the layer L5 and are electrically connected by a single collector electrical contact 206. The electron emission will take place between each consecutive contact 204. The distance between two contacts 204 arranged on the surface is between 1 and 100 μm.

The solution proposed by the device for emitting electrons into a vacuum according to the invention makes it possible, by comparison to the thermionic cathodes, to cover, at lower cost, the range of powers from 10 to 100 W. Furthermore, the emission device according to the invention makes it possible to produce cold cathodes exhibiting response times that are several orders of magnitudes faster.

The invention claimed is:

1. A semiconductor device for electron emission in a vacuum, comprising: a stack of q semiconductor layers, q being a number greater than or equal to 2, of N and P type according to a sequence N/(P)/N forming a juxtaposition of two head-to-tail NP junctions, the semiconductor layers being produced in semiconductor materials belonging to a III-N family, two adjacent layers of the stack forming an interface, the stack comprising two ends, at one of its ends at least one emitter ohmic contact land on a free surface of a first layer L1 of the stack and, at the other end, at least one collector electrical contact land on a part of another free surface of an output layer L5 in contact with the vacuum for the emission of electrons by an emissive zone of said output layer L5, said semiconductor materials of the layers of the stack close to the vacuum, where the electrons reach a high energy, having a band gap Eg whose value satisfies a following inequality: Eg>c/2, where c is an electron affinity of the semiconductor material, the P-type semiconductor layer being obtained partially or completely by piezoelectric effect so as to exhibit a negative fixed charge ($\sigma^-$) in any one of interfaces between the layers of the stack, the piezoelectric effect being of a spontaneous and/or constrained type, said device further comprising: biasing means for applying a positive bias potential (Vce) to one of contact lands relative to a reference potential (M) applied to the other contact land so as to forward bias a junction set to the reference potential (M) and reverse bias the one set to the positive bias potential (Vce), an internal electrical field induced by the positive bias potential applied to the stack of semiconductor layers supplying, to a fraction of the electrons circulating in said stack, the energy needed for their emission in the vacuum by the emissive zone of the output layer L5, the stack comprising: between its two ends, the first layer L1 of N type, a layer L3 of P type, a layer L4 of N or P type and the output layer L5 of N type on the layer L4, the positive bias potential being applied to the electrical contact of the collector of the output layer L5, the reference potential being applied to the electrical contact of the first layer L1; and a semiconductor layer L2 between the first layer L1 and the layer L3 of P type, wherein adjacent layers L2 and L3 exhibit a composition difference such that a piezoelectric charge of negative sign appears at an interface of these layers, wherein a composition of the semiconductor material of the layer L2 is different from a composition of the material of the layer L1 in such a way that a positive piezoelectric charge ($\sigma+$) appears at an interface between these two layers.

2. The semiconductor device as claimed in claim 1, wherein the negative fixed charge ($\sigma^-$) in the stack is also obtained by doping of the layer L3 with impurities of acceptor type.

3. A semiconductor device for electron emission in a vacuum, comprising: a stack of q semiconductor layers, q being a number greater than or equal to 2, of N and P type according to a sequence N/(P)/N forming a juxtaposition of two head-to-tail NP junctions, the semiconductor layers being produced in semiconductor materials belonging to a III-N family, two adjacent layers of the stack forming an interface, the stack comprising two ends, at one of its ends at least one emitter ohmic contact land on a free surface of a first layer L1 of the stack and, at the other end, at least one collector electrical contact land on a part of another free surface of an output layer L5 in contact with the vacuum for the emission of electrons by an emissive zone of said output layer L5, said semiconductor materials of the layers of the stack close to the vacuum, where the electrons reach a high energy, having a band gap Eg whose value satisfies a following inequality: Eg>c/2, where c is an electron affinity of the semiconductor material, the P-type semiconductor layer being obtained partially or completely by piezoelectric effect so as to exhibit a negative fixed charge ($\sigma^-$) in any one of interfaces between the layers of the stack, the piezoelectric effect being of a spontaneous and/or constrained type, said device further comprising: biasing means for applying a positive bias potential (Vce) to one of contact lands relative to a reference potential (M) applied to the other contact land so as to forward bias a junction set to the reference potential (M) and reverse bias the one set to the positive bias potential (Vce), an internal electrical field induced by the positive bias potential applied to the stack of semiconductor layers supplying, to a fraction of the electrons circulating in said stack, the energy needed for their emission in the vacuum by the emissive zone of the output layer L5, the stack comprising: between its two ends, the first layer L1 of N type, a layer L3 of P type, a layer L4 of N or P type and the output layer L5 of N type on the layer L4, the positive bias potential being applied to the electrical contact of the collector of the output layer L5, the reference potential being applied to the electrical contact of the first layer L1 wherein the negative fixed charge is also obtained between the layer L4 and the first layer L1 partly by doping of the layer L3 with impurities of acceptor type and partly by piezoelectric effect by the choice of the chemical composition of the layer L1, said layer having a composition of $Al_xGa_{1-x}N$ or $Al_xIn_{1-x}N$ type and the layers L3, L4 and L5 having a composition of the $Al_yGa_{1-y}N$ or $Al_yIn_{1-y}N$ type with x greater than 0 and less than or equal to 1 and with y greater than or equal to 0 and less than 1 and such that x>y.

4. The semiconductor device as claimed in claim 1, wherein the stack comprises the first layer L1 of N type, the output layer L5 of N type and, between the first layer L1 and the output layer L5, a layer L4 of N type, the negative charge ($\sigma^-$) being obtained between the layer L4 and the first layer L1 by piezoelectric effect.

5. A semiconductor device for electron emission in a vacuum, comprising: a stack of q semiconductor layers, q being a number greater than or equal to 2, of N and P type according to a sequence N/(P)/N forming a juxtaposition of two head-to-tail NP junctions, the semiconductor layers being produced in semiconductor materials belonging to a III-N family, two adjacent layers of the stack forming an interface, the stack comprising two ends, at one of its ends at least one emitter ohmic contact land on a free surface of a first layer L1 of the stack and, at the other end, at least one collector electrical contact land on a part of another free surface of an output layer L5 in contact with the vacuum for the emission of electrons by an emissive zone of said output layer L5, said semiconductor materials of the layers of the stack close to the vacuum, where the electrons reach a high energy, having a band gap Eg whose value satisfies a following inequality: Eg>c/2, where c is an electron affinity of the semiconductor material, the P-type semiconductor layer being obtained partially or completely by piezoelectric effect so as to exhibit a negative fixed charge ($\sigma^-$) in any one of interfaces between the layers of the stack, the piezoelectric effect being of a spontaneous and/or constrained type, said device further comprising: biasing means for applying a positive bias potential (Vce) to one of contact lands relative to a reference potential (M) applied to the other contact land so as to forward bias a junction set to the reference potential (M) and reverse bias the one set to the positive bias potential (Vce), an internal electrical field induced by the positive bias potential applied to the stack of semiconductor layers supplying, to a fraction of the electrons circulating in said stack, the energy needed for their emission in the vacuum by the emissive zone of the output layer L5, wherein the stack comprises the first layer L1 of N type, the output layer L5 of N type and, between the first layer L1 and the output layer L5, a layer L2 of P type and a layer L4 of N type, with a doping less than $5\times10^{17}cm^{-3}$, the negative charge being induced by piezoelectric effect at the interface between these said adjacent layers by the choice of a chemical composition of the layers L1 to L4, said layers will have a composition of the $Al_xGa_{1-x}N$ or $Al_xIn_{1-x}N$ type for the layers L1 and L2 and a chemical composition of the $Al_yGa_{1-y}N$ or $Al_yIn_{1-y}N$ type for the layers L3 and L4, with x greater than 0 and less than or equal to 1 and with y greater than or equal to 0 and less than 1and such that x>y.

6. The semiconductor device as claimed in claim 1, wherein the stack comprises the first layer L1 of N type, the output layer L5 of N type and, between the first layer L1 and the output layer L5, a layer L2 of N type and a layer L4 of N type, the negative charge being induced by piezoelectric effect at the interface between two layers.

7. The semiconductor device as claimed in claim 1, wherein the stack comprises a semiconductor layer L2 of any type having a thickness less than 200 nm adjacent to the first layer L1.

8. The semiconductor device as claimed in claim 1, wherein the output layer L5 of N type is doped between $10^{18}cm^{-3}$ and $10^{20}cm^{-3}$ and is of a thickness t less than or equal to 50 nm.

9. The semiconductor device as claimed in claim 1, wherein the semiconductor layer L4 of N or P type adjacent to the output layer L5 has a doping less than $5\times10^{17}cm^{-3}$ and is of a thickness less than or equal to 100 nm.

10. The semiconductor device as claimed in claim 1, wherein the doped semiconductor layer L3 of P type between some $10^{18}cm^{-3}$ and some $10^{20}cm^{-3}$ arranged between the output layer L5 and the first layer L1 has a thickness less than 200 nm.

11. The semiconductor device as claimed in claim 1, wherein the stack comprises a semiconductor layer L2 between the first layer L1 and the layer L3 of any type having a thickness less than 200 nm adjacent to the layer L1.

12. The semiconductor device as claimed in claim 1, wherein the doped first layer L1 of N type between some $10^{18}cm^{-3}$ and some $10^{20}cm^{-3}$ is of any thickness.

13. The semiconductor device as claimed in claim 4, wherein a composition of the semiconductor materials of the adjacent layers L1 and L4 is chosen so as to exhibit a composition difference such that a piezoelectric charge of negative sign appears at the interface between these layers L1 and L4.

14. The semiconductor device as claimed in claim 5, wherein the semiconductor materials of the adjacent layers L2 and L4 exhibit a composition difference such that a piezoelectric charge of negative sign appears at an interface of these layers.

15. The semiconductor device as claimed in claim 1, wherein the layers L1 and/or L2 are chosen from the semiconductor materials:

$$Al_xGa_{1-x}N,\ In_xGa_{1-x}N,\ Al_xIn_{1-x}N \text{ or } (In_yAl_{1-y})_xGa_{1-x}N.$$

16. The semiconductor device as claimed in claim 1, wherein, the layers L1 and/or L2 being of $In_{17}Al_{83}N$, the other layers of the stack are of GaN so that mesh parameters of these layers are identical.

17. The semiconductor device as claimed in claim 1, wherein the layer L3 is doped between some $10^{18}cm^{-3}$ and some $10^{20}cm^{-3}$ at a thickness less than 200 nm.

18. The semiconductor device as claimed in claim 1, wherein the stack is produced from a substrate chosen from gallium nitride or GaN, silicon carbide or SiC, silicon or Si, sapphire or $Al_2O_3$.

19. The semiconductor device as claimed in claim 1, wherein the emitter ohmic contact land on the first layer L1 is on a peripheral zone of said layer L1, to receive the positive bias potential.

20. The semiconductor device as claimed in claim 1, wherein the emitter ohmic contact land on the layer L1 is arranged at the periphery to form a closed contour.

21. The semiconductor device as claimed in claim 1, wherein the emitter ohmic contact land on the first layer L1 comprises two contact parts arranged at a periphery and facing one another.

22. The semiconductor device as claimed in claim 21, wherein the two emitter ohmic contact parts are from 1 to 10 μm away from the collector mesa consisting of the layers L2 to L5.

23. The semiconductor device as claimed in claim 1, wherein the emitter ohmic contact land is on the rear face of the first layer L1, on a zone of said first layer L1 vertically in line with the emissive zone.

24. The semiconductor device as claimed in claim 1, wherein the collector electrical contact land on the output layer L5 is a Schottky contact land arranged on a peripheral zone of said output layer L5, to receive a bias voltage (Vcs).

25. The semiconductor device as claimed in claim 1, wherein the collector electrical contact land on the output layer L5 is arranged at the periphery to form a closed contour.

26. The semiconductor device as claimed in claim 1, wherein the output layer L5 comprises two collector electrical contact lands arranged at the periphery of said layer and facing one another at a distance of between 1 μm and 100 μm.

27. The semiconductor device as claimed in claim 1, wherein the first layer L1 and the output layer L5 each comprise a multitude of mutually parallel contact lands separated by a distance of between 1 μm and 100 μm.

* * * * *